US011982002B2

(12) United States Patent
Zheng et al.

(10) Patent No.: US 11,982,002 B2
(45) Date of Patent: May 14, 2024

(54) METHOD FOR ANTI-CORROSION TREATMENT OF METALLIC COPPER-CONTAINING MATERIALS

(71) Applicant: XIAMEN UNIVERSITY, Xiamen (CN)

(72) Inventors: Nanfeng Zheng, Xiamen (CN); Jian Peng, Xiamen (CN); Shuqiang Hao, Xiamen (CN); Binghui Wu, Xiamen (CN); Xiaoliang Fang, Xiamen (CN)

(73) Assignee: XIAMEN UNIVERSITY, Xiamen (CN)

( * ) Notice: Subject to any disclaimer, the term of this patent is extended or adjusted under 35 U.S.C. 154(b) by 150 days.

(21) Appl. No.: 16/641,780

(22) PCT Filed: Aug. 17, 2018

(86) PCT No.: PCT/CN2018/101011
§ 371 (c)(1),
(2) Date: Feb. 25, 2020

(87) PCT Pub. No.: WO2019/042159
PCT Pub. Date: Mar. 7, 2019

(65) Prior Publication Data

US 2020/0224320 A1 Jul. 16, 2020

(30) Foreign Application Priority Data

Aug. 28, 2017 (CN) ..... 201710750568.9
Aug. 28, 2017 (CN) ..... 201710751393.3
Aug. 28, 2017 (CN) ..... 201710751521.4
Aug. 28, 2017 (CN) ..... 201710752263.1

(51) Int. Cl.
*C23F 11/00* (2006.01)
*C22C 9/00* (2006.01)
*C23F 11/12* (2006.01)
*C23F 11/14* (2006.01)
*C23F 11/16* (2006.01)

(52) U.S. Cl.
CPC ..... *C23F 11/122* (2013.01); *C22C 9/00* (2013.01); *C23F 11/16* (2013.01)

(58) Field of Classification Search
CPC ..... C23F 11/00; C23F 11/08; C23F 11/10; C23F 11/12; C23F 11/122; C23F 11/124; C23F 11/14; C23F 11/141; C23F 11/144; C22C 9/00; C22C 38/16
See application file for complete search history.

(56) References Cited

U.S. PATENT DOCUMENTS 3,940,248 A * 2/1976 Yamaguchi ..... C23F 11/149 252/392
2005/0016416 A1* 1/2005 Bengston ..... C23C 18/405 106/1.23
2009/0068846 A1* 3/2009 Radzewich ..... G03F 7/425 438/754
2014/0097231 A1* 4/2014 Hirao ..... B23K 35/365 174/257

FOREIGN PATENT DOCUMENTS

CN 101274367 A * 10/2008
CN 105369271 A * 3/2016

OTHER PUBLICATIONS

Machine translation of CN-101274367-A. (Year: 2008).*
The low temperature exothermic sintering of formic acid treated Cu nanoparticles for conductive ink, Liu et al., Journal of Materials Science: Materials in Electronics · Dec. 2016. (Year: 2016).*
Synthesis of oxidation-resistant core-shell copper nanoparticles, RSC Adv., 2013, 3, 15169-15177. (Year: 2013).*
Machine translation of CN-105369271-A (Year: 2016).*
Surface coordination layer passivates oxidation of copper, Peng et al., Nature | vol. 586 | Oct. 15, 2020, pp. 390-415.*
Durable Oxidation-Resistance of Copper via Light-Powered Bidentate Binding of Carbon Dioxide Anion Radicals, Jiang et al., ACS Materials Lett. 2022, 4, 1967-1975.*

* cited by examiner

*Primary Examiner* — Haidung D Nguyen
(74) *Attorney, Agent, or Firm* — PROI Intellectual Property US; Klaus Michael Schmid

(57) ABSTRACT

An anticorrosion treatment method for a copper-containing material comprises: carrying out a sealed and pressurized reaction on a copper-containing material and a stabilizer in presence of a polar solvent and any assistant, the stabilizer being a compound capable of providing formates, so that the formates are adsorbed on the surface of the copper-containing material. In the method, formates are modified on the surface of the copper-containing material, accordingly, the oxidation resistance capability and the stability of the copper-containing material can be significantly improved while the electrical conductivity of the copper-containing material is not reduced, and the corrosion resistance of the copper-containing material and especially, the salt and alkali corrosion resistance of the copper-containing material are significantly improved.

7 Claims, 9 Drawing Sheets

METHOD FOR ANTI-CORROSION TREATMENT OF METALLIC COPPER-CONTAINING MATERIALS

TECHNICAL FIELD

The present invention belongs to the field of material surface treatment, and in particular relates to a method for anti-corrosion treatment of metallic copper-containing materials.

BACKGROUND

Copper is one of metal materials with the longest history of human use. It is well known that, metallic copper itself has high electrical conductivity, thermal conductivity, excellent formability and low price, and is widely used in electric power industry, machinery and vehicle manufacturing industry, chemical industry, construction industry, national defense industry and the like fields. However, metallic copper-containing materials are easily oxidized in air and their surface is easily corroded, which greatly reduces their conductivity, roughens their surface and darkens their colors, thereby limiting their applications.

Copper has a relatively positive potential compared with that of a standard hydrogen electrode, but a relatively negative potential compared with that of a standard oxygen electrode. Therefore, cathodic oxygen absorption corrosion possibly occurs under most conditions, and thus hydrogen cannot be evoluted from an acid. When there is no oxidant in an acid, alkali or air, copper can be corrosion-resistant; and when an oxidant is present, copper will be corroded.

The copper corrosion is divided into chemical corrosion, electrochemical corrosion and physical corrosion according to a basic principle process. The chemical corrosion refers to the damage caused by a direct redox reaction between a copper surface and a surrounding medium. In the process of corrosion, electron transfer is carried out directly between copper and an oxidant. The electrochemical corrosion is a damage caused by an electrochemical reaction between the copper surface and an ion-conducting dielectric. It is also the most general and most common corrosion, and is also a kind of serious corrosion. The corrosion of copper in atmosphere, seawater, soil, and acid, salt and alkali media is mostly the electrochemical corrosion. The electrochemical corrosion can work together with mechanical, dynamical and biological damages to aggravate the loss of the metallic copper. The physical corrosion refers to the damage to copper caused by a simple physical action, and the proportion of such corrosion is small.

At present, the anti-oxidation and anti-corrosion surface treatment methods of copper mainly include:

(1) surface plating with an inert metal: a layer of relatively inert metal, such as gold, palladium and silver, is plated on the surfaces of metallic copper-containing materials by chemical plating or vacuum vapor plating;

(2) cathodic protection with a sacrificial metal anode: surface plating is conducted with tin, zinc, etc.;

(3) treatment with a coupling agent: the surfaces of the metallic copper-containing materials are subjected to cover treatment with a titanate or silane coupling agent;

(4) addition of an appropriate amount of an organic stabilizer: the organic stabilizer may be an amine, an aldehyde, a phenol, a carboxylic acid and the like, which reduces the oxide film on the surfaces of the metallic copper-containing materials to metallic copper and inhibit the oxidation thereof; and (5) surface hydrophobic treatment: an oleic acid, oleylamine or stearate is adopted to carry out hydrophobic treatment on the surfaces of the metallic copper-containing materials.

Each of the methods (1) and (2) has a good anti-oxidation effect, but has a high cost and a complicated process. The copper materials obtained by the methods (3)-(5) can play a certain anti-oxidation role, but copper will still be oxidized slowly in a weak oxidizing atmosphere.

In the prior art, corresponding to the method (1), CN03135246.4 discloses a method for preparing composite copper powder and composite copper conductor slurry for electric conduction, wherein anti-oxidation copper powder is prepared by adopting a silver-coated copper strategy. Due to the high price of silver and the mobility problem of silver, the large-scale application of this method is limited.

Corresponding to the method (2), CN201210398033.7 discloses a high-strength corrosion-resistant six-element brass alloy, wherein the copper alloy prepared from iron, manganese, nickel, zinc and silver has a high strength and can resist acid corrosion; however, the complex preparation process and weak alkali-corrosion resistance limit its large-scale application.

Corresponding to the method (3), CN92100920.8 discloses a method for conducting surface treatment of conductive copper powder, wherein firstly, the organic matter is removed from the surface by a conventional organic solvent washing method, then the oxide film is removed from copper with an acid, and the product is washed until neutral, and then treated with the coupling agent and a ZB-3 composite treatment agent. The conductive copper powder prepared by this method can be used as a conductive filler in a conductive coating, a conductive ink and a conductive adhesive. However, this method not only requires use of expensive chemical reagents, but also only removes the oxide film from the surface of the copper powder by acid pickling, without inerting an active part on the surface of the copper powder; also, at a later stage of the acid pickling, the pH value of the solution system will increase and the surface of the copper powder will be oxidized again. This layer of oxide film belongs to a low-temperature oxide film, is loose and porous, and thus it is difficult for it to play the role of inhibiting oxidation. Therefore, this method is not suitable for the treatment of the copper powder.

Corresponding to the method (4), CN200710034616.0 discloses a method for modifying a surface of copper powder for a conductive paste, which includes: firstly, removing an organic matter from the surface of the copper powder by using an organic acid mixture; secondly, adding a stabilizer to carry out a recrystallization reaction in an inert gas; and thirdly, adding diethylene diamine and the like to carry out carbon coating. Although this method improves the oxidation resistance of the copper powder, it requires three steps and the process is complicated; and also, it needs to be carried out in an inert atmosphere, and thus the reaction conditions are harsh. This will definitely bring about an increase in the cost.

Corresponding to the method (5), CN201110033990.5 discloses a method of imparting oxidation resistance to nano copper powder, which includes: preparing an organic acid aqueous solution with a mass concentration of 0.1%-2%, with the pH of the solution being controlled at 1-5; adding copper powder into the organic acid aqueous solution, continuously stirring, allowing the mixture to stand, and filtering out the supernatant; preparing a copper powder corrosion-inhibiting solution with a mass concentration of 0.1%-2%; adding the copper powder slurry into the copper powder corrosion-inhibiting solution, fully stirring, allowing the mixture to stand, and filtering out the supernatant to obtain a copper powder slurry; replacing the copper powder slurry with an organic solvent for 2-4 times, and then conducting fractionation; weighing a alcohol-soluble organic matter at 0.1%-5% of the weight of the copper powder contained in the copper powder slurry, dissolving it in an alcohol solvent to prepare a copper powder corrosion-inhibiting solution with a concentration of 0.25%-5%, adding the obtained copper powder slurry into the aforementioned copper powder corrosion-inhibiting solution, and stirring for 0.5-2 h. The method can cover a layer of protective film on the surface of the nano copper powder to effectively isolate oxygen, thereby achieving the purpose of oxidation resistance of the copper powder, but the operation process is complicated and the cost is inevitably increased.

Therefore, it is currently a technical problem to develop a simple and efficient oxidation-resistant and corrosion-resistant surface treatment method for metallic copper-containing materials, in order to solve the use of copper in the fields of electric power industry, machinery and vehicle manufacturing industry, chemical industry, construction industry, national defense industry, etc.

SUMMARY

After in-depth research, the inventor of the present invention has discovered that modifying the surfaces of metallic copper-containing materials with a formate can significantly enhance the oxidation resistance and stability of the metallic copper-containing materials while not reducing their conductivity, and the corrosion resistance of the obtained metallic copper-containing materials, especially the saline-alkali corrosion resistance, can be significantly improved. The present invention is completed based on this.

Particularly, the present invention provides a method for anti-corrosion treatment of metallic copper-containing materials, including subjecting the metallic copper-containing materials and a stabilizer to a sealing and pressurizing reaction in the presence of a polar solvent and an optional additive, wherein the stabilizer is a compound capable of providing a formate, so that the formate is adsorbed on the surfaces of the metallic copper-containing materials.

According to a specific embodiment of the present invention, the method for anti-corrosion treatment includes mixing the metallic copper-containing materials with the polar solvent, adding the stabilizer and the additive, then conducting the sealing and pressurizing reaction, and then performing liquid-solid separation, washing, and drying.

The stabilizer can be various existing compounds capable of providing a formate, and preferably formic acid and/or a formate. The specific examples of the formate include, but are not limited to at least one of lithium formate, sodium formate, cesium formate, magnesium formate, aluminium triformate, potassium formate, ammonium formate, calcium formate, zinc formate, iron formate, copper formate, strontium formate, barium formate, beryllium formate, nickel formate, cobalt formate, and manganese formate. Furthermore, the mass ratio of the stabilizer to the metallic copper-containing materials is preferably 10:1-1:10.

The present invention has no specific limitation on the type of the polar solvent, and the polar solvent may be water and/or various existing polar organic solvents, and is preferably at least one selected from water, an amide solvent, an alcohol solvent, an ester solvent, and an ether solvent. Specific examples of the amide solvent include, but are not limited to, at least one of formamide, dimethylformamide, diethylformamide, dimethylacetamide, diethylacetamide, and dimethylpropionamide. Specific examples of the alcohol solvent include, but are not limited to, at least one of monohydric alcohol, dihydric alcohol and polyhydric alcohol. Specific examples of the ester solvent include, but are not limited to, at least one of ethyl acetate, methyl acetate, n-butyl acetate, n-pentyl acetate, ethyl valerate, ethyl propionate, ethyl butyrate, ethyl lactate, ethyl nonanoate, triethyl phosphate, ethyl caproate, ethyl formate, ethyl cyclohexanecarboxylate, ethyl heptanoate, and ethyl cinnamate. Specific examples of the ether solvent include, but are not limited to, at least one of methyl ether, diethyl ether, diphenyl ether, ethylene oxide, and tetrahydrofuran.

The additive is preferably an organic amine; and more preferably oleylamine, and/or an alkylamine with a molecular formula conforming to $CnH2n+3N$, wherein $1 \leq n \leq 18$. The mass ratio of the organic amine to the metallic copper-containing materials is preferably 50:1-1:100 when addition of the organic amine is needed.

The present invention has no specific limitation on the conditions of the sealing and pressurizing reaction, as long as the formate provided by the stabilizer can be attached to the surfaces of the metallic copper-containing materials. For example, for the sealing and pressurizing reaction, the temperature can be 20-300° C., and preferably 120-180° C.; and the time can be 0.01-100 h, and preferably 6-30 h.

The present invention has no specific limitation on the type of the metallic copper-containing materials, and the metallic copper-containing materials can be various existing materials made of copper, including a pure copper material (cupronickel, brass), a copper alloy, and the like, and in particular can be at least one selected from a copper foil, a copper foam, copper powder, a copper cable, a copper faucet, a copper nanowire, and a copper wire.

According to a specific embodiment of the present invention, when the metallic copper-containing materials are the copper nanowires, the method for anti-corrosion treatment includes the following steps:

1) adding the copper nanowire into a dispersant, then adding a polar organic solvent and/or water, and mixing to obtain a copper nanowire dispersion solution;

2) adding the stabilizer into the copper nanowire dispersion solution obtained in the step 1), and mixing to obtain a mixed solution;

3) placing the mixed solution into a pressurized and heated sealing system for a sealing reaction; and 4) cooling the mixed solution obtained in step 3), then performing liquid-solid separation, and washing.

The diameter of the copper nanowire is preferably 10-200 nm.

The dispersant is preferably at least one selected from polyethylene glycol, polyvinylpyrrolidone, polyacrylic acid, polyacrylamide, sodium dodecyl sulfate, polyoxyethylene-8-octylphenyl ether, and cetyl trimethyl ammonium bromide. Furthermore, the mass ratio of the dispersant to the copper nanowire is preferably 100:1-1:100.

According to another specific embodiment of the present invention, when the metallic copper-containing materials are the copper wires, the method for anti-corrosion treatment includes the following steps:

1) conducting surface cleaning;

2) conducting anti-corrosion treatment, which comprises putting the copper wire into a polar solvent containing the stabilizer, and conducting the sealing and pressurizing reaction in a pressure container; and (3) washing the copper wire after the anti-corrosion treatment with water and/or ethanol, and drying.

According to the present invention, during the anti-corrosion treatment of the copper wire, in the step 1), the specific steps of the surface cleaning are:

(1) removing an organic matter from the copper wire;

(2) cleaning the copper wire with running water;

(3) subjecting the copper wire to acid pickling;

(4) subjecting the copper wire to rinsing; and (5) drying the copper wire.

In part (1) of the step 1), the copper wire is a pure copper wire or a copper alloy wire.

In part (1) of the step 1), ethanol is adopted to remove the organic matter from the copper wire; and the time for removing the organic matters from the copper wire is 15-100 min.

In part (1) of the step 3), the solvent used for the acid pickling is sulfuric acid, the molar concentration of the sulfuric acid is 0.05-0.15 mol/L, and the time for the acid pickling time is 5-100 min.

In part (4) of the step 1), the rinsing is conducted with a solvent of ethanol and/or water for a time of 5-100 min.

According to a further specific embodiment of the present invention, when the metallic copper-containing materials are the copper alloys, the method for anti-corrosion treatment includes the following steps:

1) subjecting the copper alloy to surface cleaning;

2) conducting anti-corrosive treatment of the copper alloy, which comprises putting the copper alloy into a polar solvent containing the stabilizer, and conducting the sealing and pressurizing reaction in a pressure container; and 3) cleaning the copper alloy after the anti-corrosive treatment with a solvent, and drying.

According to the present invention, during the anti-corrosion treatment of the copper alloy, in the step 1), the specific steps of the surface cleaning of the copper alloy are:

(1) removing an organic matter from the copper alloy;

(2) cleaning the copper alloy with running water;

(3) removing an oxide film from the copper alloy;

(4) subjecting the copper alloy to rinsing; and (5) drying the copper alloy.

In part (1) of the Step 1), the copper alloy is selected from one of copper-nickel alloy, copper-zinc alloy, and copper-tin alloy.

In part (1) of the Step 1), ethanol is adopted to remove the organic matter from the copper alloy; and the time for removing the organic matter from the copper alloy is 15-100 min.

In part (3) of the Step 1), acetone is adopted to remove the oxide film from the copper alloy, and the time for removing the oxide film from the copper alloy is 5-100 min.

In part (4) of the Step 1), the copper alloy is rinsed with a solvent of ethanol and/or water for a time of 5-100 min.

In the step 3), the solvent is water and/or ethanol.

The beneficial effects of the present invention are as follows:

1. The surfaces of the metallic copper-containing materials are treated with a formate-containing compound, where since the formate has a redox potential lower than that of copper and slow oxidation kinetics, it has a good protective effect on the metallic copper-containing materials, can effectively prevent the chemical or electrochemical corrosion of copper, prolong the service life of copper, reduce the risk brought about by corrosion, and improve the service life of the metallic copper-containing materials. Meanwhile, the formic acid or formate is cheap and environmentally friendly.

2. It is suitable for anti-corrosion treatment of all metallic copper-containing materials that have a zero valence or is partly oxidized on the surface.

3. The treated metallic copper-containing materials have stronger oxidation resistance (including high-temperature oxidation resistance), saline-alkali corrosion resistance and higher conductivity than those before treatment, and can be used in the fields of copper-based conductive paste, transparent conductive films containing a copper nanowire, copper cables and wires, printed circuit boards, motors, transformers and the like.

4. Compared with the unmodified metallic copper-containing materials, the formate-modified metallic copper-containing materials have better surface gloss.

5. The treated metallic copper-containing materials have better oxidation resistance than that before modification, avoids the use of lead, chromium and cadmium, and the like metals or cyanides with potential toxicity, and thus conforms to the relevant provisions of the Environmental Protection Act of the People's Republic of China. Furthermore, when the metallic copper-containing materials are the copper nanowires, its contact resistance can also be kept consistent at a relatively low level, and is suitable for the fields of transparent conductive films, conductive inks and the like.

6. It has simple operation, a low cost, strong market competitiveness, suitability for large-scale production, and easy industrialization.

BRIEF DESCRIPTION OF THE DRAWINGS

The above and other objectives, features and advantages of the present invention will become more apparent by describing exemplary embodiments of the present invention in conjunction with the accompanying drawings in more detail.

In FIG. 1, it is shown that the surface of the unmodified copper powder is rough and has many copper oxide particles, and thus the surface is easily oxidized.

In FIG. 2, it is shown that the surface of the formate-modified copper powder is smooth and flat, and has very strong oxidation resistance.

In FIG. 3, it is shown that the peak of the (111) crystal plane of cuprous oxide becomes more and more obvious over time as the unmodified copper powder is heated at 150° C., and the copper powder slowly turns black and the oxidation degree becomes higher and higher.

In FIG. 4, it is shown that the formate-modified copper powder is heated at 150° C., with the increase of time, there is almost no peak of a copper oxide, and the copper powder remains brownish red, indicating that it has strong oxidation resistance.

In FIG. 5, it is shown that the surface of the formate-modified spherical copper powder is smooth and flat, and has strong oxidation resistance.

In FIG. 6, it is shown that the surface of the formate-modified flake copper powder is smooth and flat, and has strong oxidation resistance.

In FIG. 7, it is shown that the surface of the unmodified copper nanowire becomes rough and is easily oxidized.

In FIG. 8, it is shown that the surface of the formate-modified copper nanowire is smooth and flat, and has strong oxidation resistance.

In FIG. 9, the alkali treatment conditions are a 0.1 M sodium hydroxide aqueous solution, a temperature of 60° C., and a treatment time of 24 h, which indicates that the copper wire itself is not alkali resistant, and has good alkali resistance after being modified by a formate.

FIG. 15 illustrates that the unmodified copper nanowire has a rough surface and many copper oxide particles after being oxidized at 80° C.

FIG. 16 illustrates that the formate-modified copper nanowire is relatively stable, and has little surface change.

FIG. 18 illustrates that the peak of the (111) crystal plane of cuprous oxide appears after the unmodified copper nanowire is heated at 80° C. for 48 h, and the copper wire slowly turns black, while the formate-modified copper nanowire is still red after being heated at 80° C. for 48 h, and no peak of copper oxide occurs.

In FIG. 19, it is shown that the formate-modified copper nanowire is heated at 80° C., and with the increase of time, almost no increase in resistance occurs, and the copper nanowire remains reddish brown, indicating that it has strong oxidation resistance; while after the unmodified copper nanowire is heated at 80° C., the resistance gradually increases and the copper nanowire is gradually oxidized to black.

DESCRIPTION OF THE EMBODIMENTS

Figure 1:
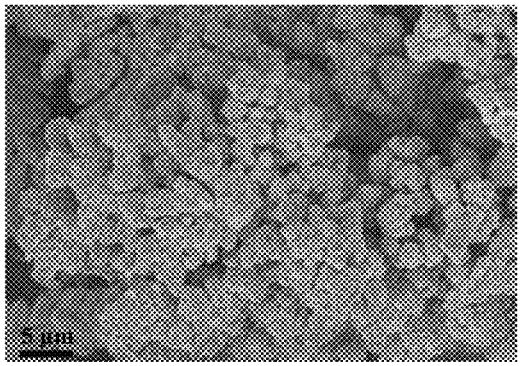
FIG. 1 is an SEM image of copper powder (200 mesh) without formate modification of Example 1-3 after being placed in an air atmosphere at 100° C. for 24 h.

Hereinafter, embodiments of the present invention will be described in detail, and examples of the embodiments are intended to explain the present invention and should not be construed as limiting the present invention. If no specific technology or condition is indicated in the examples, it shall be carried out according to the technology or condition described in the literature in the art or according to product instructions. All of the used agents or instruments which are not specified with the manufacturer are conventional commercially available products.

Example 1-1

A copper foil with a mass of 200 mg and a thickness of 0.05 mm was weighed with an electronic balance, ultrasonically washed with ethanol for 10 min to remove an organic matter from the surface, then rinsed with deionized water to remove the ethanol from the surface, soaked in 0.1 M diluted hydrochloric acid and subjected to ultrasonic treatment for 10 min to remove the oxide layer from the surface, then ultrasonically washed with water for 10 min, and dried. The cleaned copper foil was placed in a solution containing 200 mg of sodium formate, 1 mL of deionized water and 20 mL of a N,N-dimethylformamide (DMF) solution for ultrasonic treatment for 3 min, transferred into a reaction kettle, heated from room temperature to 160° C. for 30 min, then kept at 160° C. for 20 h, naturally cooled, and washed with water and ethanol for many times, so as to obtain the formate-modified antioxidative copper foil. The resistance change of the copper foil before and after modification was measured by a multimeter (with an electrode spacing of 2 cm). The resistance of the unmodified copper foil was increased from 0.2Ω to 58.4Ω after being placed in air atmosphere at 100° C. for 24 h; and the resistance of the formate-modified copper foil remained almost unchanged (at 0.3Ω) after being placed at 100° C. for 24 h.

Example 1-2

200 mg of copper foam was weighed, ultrasonically washed with ethanol for 10 min to remove an organic matter from the surface, then rinsed with deionized water to remove the ethanol from the surface, and dried. The cleaned copper foam was placed in a high temperature and high pressure vessel containing 200 mg of formic acid and 10 mL of a formamide solution for ultrasonic treatment for 5 min, heated from room temperature to 140° C. for 20 min, then kept at 140° C. for 20 h, naturally cooled, and washed with water and ethanol for many times, so as to obtain an formate-modified antioxidative copper foam. The resistance change of the copper foam before and after modification was measured by a multimeter (with an electrode spacing of 2 cm). The resistance of the unmodified copper foam was increased from 0.2Ω to 6.5Ω after being placed in air atmosphere at 100° C. for 24 h; and the resistance of the formate-modified copper foil remained almost unchanged (at 0.3Ω) after being placed at 100° C. for 24 h.

Example 1-3

Figure 3:
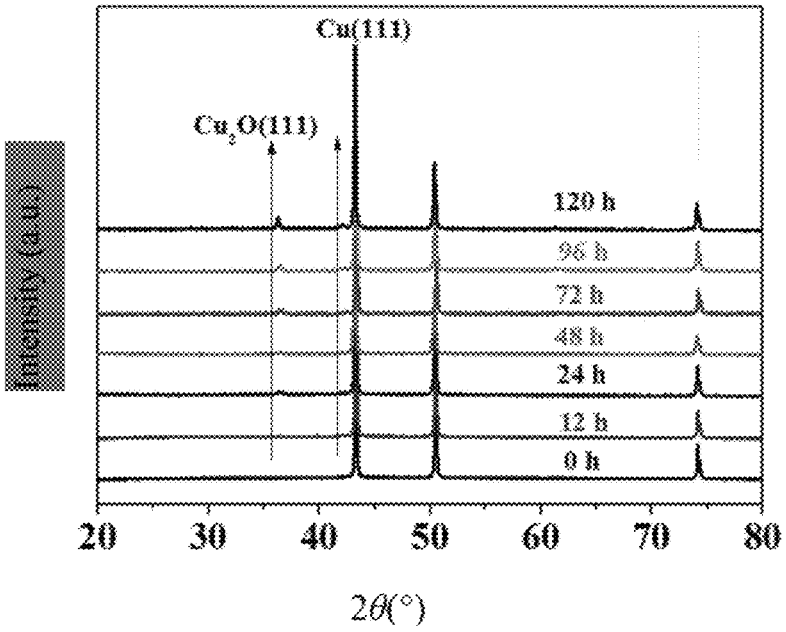
FIG. 3 is an X-ray powder diffraction (XRD) diagram of copper powder (200 mesh) without formate modification of Example 1-3 that have been heated in an air atmosphere at 150° C. for different times.

1 g of copper powder (200 mesh) was weighed, ultrasonically washed with ethanol for 10 min to remove an organic matter from the surface, then rinsed with deionized water to remove ethanol from the surface, soaked in 0.1 M diluted sulfuric acid and subjected to ultrasonic treatment for 10 min to remove the oxide layer from the surface, then ultrasonically washed with water for 10 min, and dried for later use. The copper powder was placed in a high temperature and high pressure vessel containing 2 g of potassium formate and 40 mL of a benzyl alcohol solution for ultrasonic treatment for 5 min, heated from room temperature to 160° C. for 30 min, then kept at 160° C. for 20 h, naturally cooled, washed with water and ethanol for many times, so as to obtain formate-modified antioxidative copper powder. FIG. 1 was an SEM image of unmodified copper powder (200 mesh) after being placed in air atmosphere at 100° C. for 24 h, showing that the unmodified copper powder has a rough surface and many copper oxide particles after being oxidized at 100° C. FIG. 3 was an XRD pattern of the copper powder (200 mesh) without formate modification after being heated in an air atmosphere at 150° C. for different times, which showed that the peak of the (111) crystal plane of cuprous oxide became more and more obvious over time as the unmodified copper powder was heated at 150° C., and the copper powder slowly turned black and the oxidation degree became higher and higher.

Example 1-4

Figure 2:
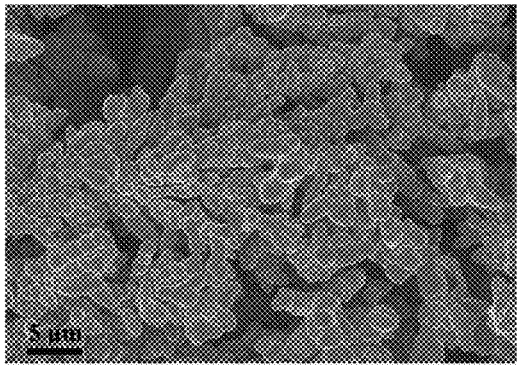
FIG. 2 is an SEM image of formate-modified copper powder (200 mesh) of Example 1-4 after being placed in an air atmosphere at 100° C. for 24 h.
Figure 4:
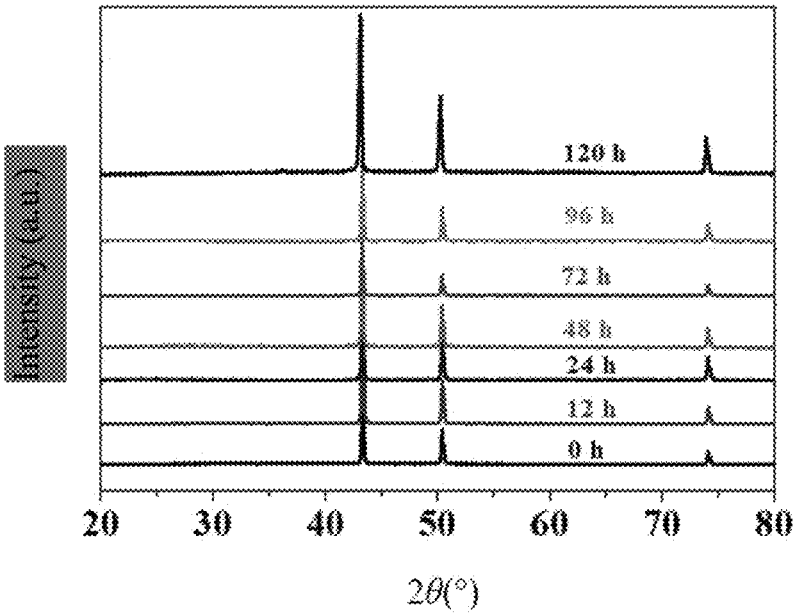
FIG. 4 is an XRD pattern of formate-modified copper powder (200 mesh) of Example 1-4 that have been heated in an air atmosphere at 150° C. for different times.

1 g of copper powder (200 mesh) was weighed, ultrasonically washed with acetone for 10 min to remove an organic matter from the surface, then rinsed with deionized water to remove acetone from the surface, soaked in 0.1 M diluted sulfuric acid and subjected to ultrasonic treatment for 20 min to remove the oxide layer from the surface, then ultrasonically washed with water for 10 min, and dried for later use. The cleaned copper powder was placed in a high temperature and high pressure vessel containing 2 g of sodium formate and 40 mL of a deionized water solution for ultrasonic treatment for 5 min, added with 1 mL of dodecylamine, heated from room temperature to 160° C. for 30 min, then kept at 160° C. for 20 h, naturally cooled, and washed with water and ethanol for many times, so as to obtain an formate-modified antioxidative copper powder. FIG. 2 was an SEM image of the formate-modified copper powder (200 mesh) after being placed in an air atmosphere at 100° C. for 24 h, showing that the surface of the formate-modified copper powder was smooth and flat. FIG. 4 was an XRD pattern of the formate-modified copper powder (200 mesh) after being heated in an air atmosphere at 150° C. for different times, which showed that the formate-modified copper powder was heated at 150° C., with the increase of time, there was almost no peak of a copper oxide, and the copper powder remained brownish red, illustrating that it had strong oxidation resistance.

Example 1-5

Figure 5:
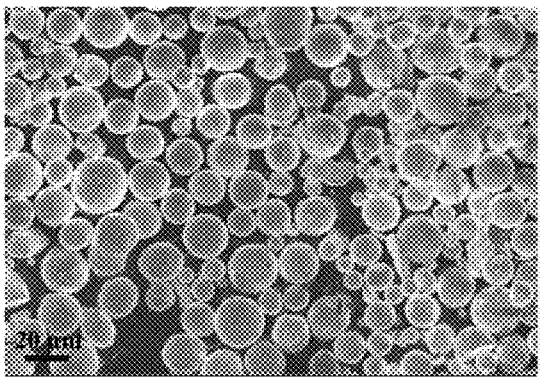
FIG. 5 is a scanning electron microscope (SEM) image of formate-modified spherical copper powder of Example 1-5 after being placed in an air atmosphere at 100° C. for 24 h.

1 g of spherical copper micro powder was weighed, ultrasonically washed with ethanol for 10 min to remove an organic matter from the surface, then rinsed with deionized water to remove ethanol from the surface, soaked in 0.1 M diluted hydrochloric acid and subjected to ultrasonic treatment for 20 min to remove the oxide layer from the surface, then ultrasonically washed with water for 10 min, and dried for later use. The cleaned copper powder was placed in a high-temperature and high-pressure vessel containing 3 g of potassium formate and 50 mL of a dimethylpropionamide solution for ultrasonic treatment for 5 min, heated from room temperature to 160° C. for 30 min, then kept at 160° C. for 20 h, naturally cooled, washed with water and ethanol for many times, so as to obtain formate-modified spherical antioxidative copper powder. FIG. 5 was an SEM image of the formate-modified spherical copper powder after being placed in an air atmosphere at 100° C. for 24 h, illustrating that the surface of the formate-modified spherical copper powder was smooth and flat.

Example 1-6

1 g of spherical copper micro powder was weighed, ultrasonically washed with acetone for 10 min to remove an organic matter from the surface, then rinsed with water for 10 min, and dried for later use. The cleaned copper powder was placed in a high temperature and high pressure vessel containing 1 g of calcium formate and 20 mL of a DMF solution for ultrasonic treatment for 5 min, added with 1 mL of oleylamine, heated from room temperature to 160° C. for 30 min, then kept at 160° C. for 20 h, naturally cooled, and washed with water and ethanol for many times, so as to obtain an formate-modified spherical antioxidative copper powder.

Example 1-7

Figure 6:
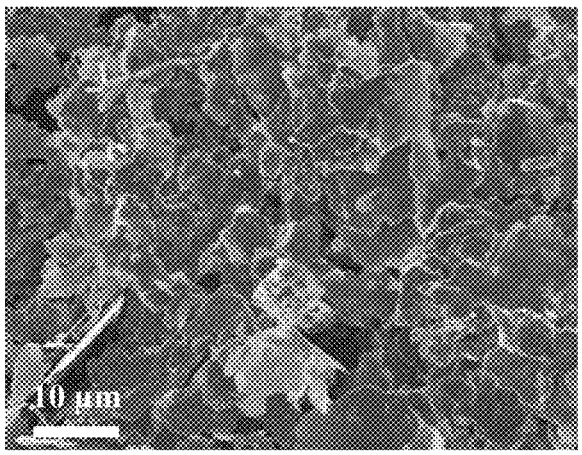
FIG. 6 is an SEM image of the formate-modified flake copper powder of Example 1-7 after being placed in an air atmosphere at 100° C. for 24 h.

1 g of flake copper micro powder was weighed, ultrasonically washed with ethanol for 10 min to remove an organic matter from the surface, then rinsed with deionized water to remove ethanol from the surface, soaked in 0.1 M diluted hydrochloric acid and subjected to ultrasonic treatment for 20 min to remove the oxide layer from the surface, then ultrasonically washed with water for 10 min, and dried for later use. The cleaned copper powder was placed in a high-temperature and high-pressure vessel containing 2 g of sodium formate and 40 mL of a DMF solution for ultrasonic treatment for 5 min, heated from room temperature to 160° C. for 30 min, then kept at 160° C. for 20 h, naturally cooled, washed with water and ethanol for many times, so as to obtain formate-modified flake antioxidative copper powder. FIG. 6 was an SEM image of the formate-modified flake copper powder after being placed at 100° C. for 24 h, illustrating that the surface of the formate-modified flake copper powder was smooth and flat.

Example 1-8

1 g of flake copper micro powder was weighed, ultrasonically washed with acetone for 30 min to remove an organic matter from the surface, then rinsed with deionized water to remove acetone from the surface, soaked in 0.1 M diluted hydrochloric acid and subjected to ultrasonic treatment for 30 min to remove the oxide layer from the surface, then ultrasonically washed with water for 30 min, and dried for later use. The cleaned copper powder was placed in a high-temperature and high-pressure vessel containing 2 g of ammonium formate and 40 mL of a DMF solution for ultrasonic treatment for 5 min, heated from room temperature to 160° C. for 30 min, then kept at 160° C. for 20 h, naturally cooled, washed with water and ethanol for many times, so as to obtain formate-modified flake antioxidative copper powder.

Example 1-9

100 mg of a copper nanowire was weighed, ultrasonically washed with ethanol for 10 min for multiple times to remove an organic matter from the surface, then rinsed with deionized water to remove ethanol from the surface, dispersed in 0.1 M diluted hydrochloric acid and subjected to ultrasonic treatment for 10 min to remove the oxide layer from the surface, then ultrasonically washed with water for 10 min, and dried for later use. The cleaned copper nanowire was placed in a high-temperature and high-pressure vessel containing 200 mg of sodium formate and 10 mL of a DMF solution for ultrasonic treatment for 5 min, heated from room temperature to 150° C. for 20 min, then kept at 150° C. for 15 h, naturally cooled, washed with water for many times, so as to obtain formate-modified antioxidative copper nanowire.

Example 1-10

Figure 7:
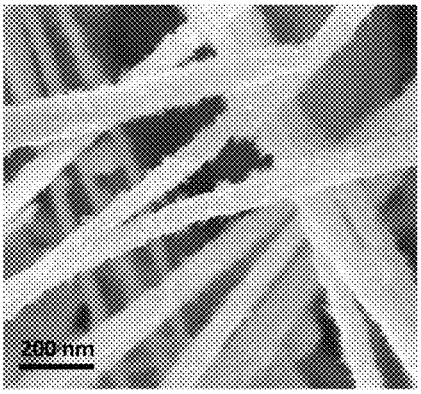
FIG. 7 is an SEM image of a copper nanowire without formate modification of Example 1-10 after being placed at room temperature for 24 h.
Figure 8:
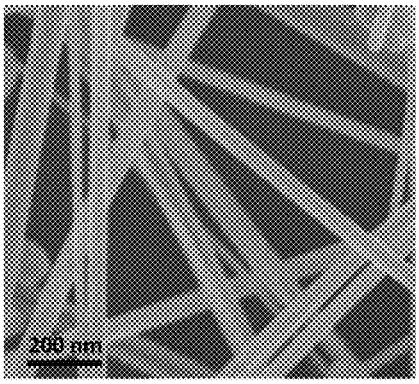
FIG. 8 is an SEM image of a formate-modified copper nanowire of Example 1-10 after being placed at room temperature for 24 h.

50 mg of a copper nanowire was weighed, ultrasonically washed with hot ethanol for 5 min for multiple times to remove an organic matter from the surface, then rinsed with deionized water to remove the ethanol from the surface, and dried. The cleaned copper nanowire was placed in a high temperature and high pressure vessel containing 100 mg of potassium formate and 10 mL of a DMF solution for ultrasonic treatment for 5 min, added with 1 mL of cetylamine, heated from room temperature to 160° C. for 30 min, then kept at 160° C. for 15 h, naturally cooled, and washed with water and ethanol for many times, so as to obtain an formate-modified antioxidative copper nanowire. FIG. 7 was an SEM image of the unmodified copper nanowire after being placed at room temperature for 24 h, illustrating that the unmodified copper nanowire was easily oxidized, and thus the surface became rough; and FIG. 8 was an SEM image of the formate-modified copper nanowire after being placed at room temperature for 24 h, showing that the surface of the formate-modified copper nanowire was smooth and flat, and the oxidation resistance was significantly enhanced.

Example 1-11

Figure 9:
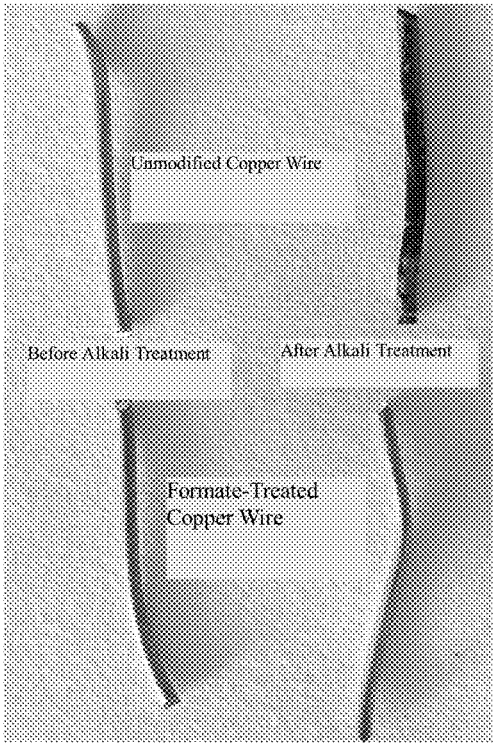
FIG. 9 shows alkali resistance of a copper wire before and after formate modification in Example 1-11.

A copper wire with a diameter of 2.5 mm and a length of 10 cm was taken, ultrasonically washed with ethanol for 20 min to remove an organic matter from the surface, then rinsed with deionized water to remove ethanol from the surface, dispersed in 0.1 M diluted sulfuric acid and subjected to ultrasonic treatment for 10 min to remove the oxide layer from the surface, then ultrasonically washed with water and ethanol for 10 min, and dried. The cleaned copper wire was placed in a high temperature and high pressure vessel containing 400 mg of sodium formate and 20 mL of a DMF solution for ultrasonic treatment for 5 min, added with 2 mL of oleylamine, heated from room temperature to 160° C. for 30 min, then kept at 160° C. for 20 h, naturally cooled, and washed with water and ethanol for many times, so as to obtain an formate-modified copper wire. The copper wires before and after formate modification were placed in a 0.1 M sodium hydroxide solution and treated at 60° C. for 24 h to investigate alkali resistance of them. FIG. 9 showed the alkali resistance investigation of copper wires before and after formate modification, showing that the unmodified copper wire itself was not alkali resistant and had strong alkali resistance after the formate modification.

Example 1-12

A cupronickel faucet was taken, ultrasonically washed with ethanol for 20 min to remove an organic matter from the surface, then rinsed with deionized water to remove the ethanol from the surface, and dried. The cleaned cupronickel faucet was placed in a high-temperature and high-pressure vessel containing 400 mg of sodium formate and 200 mL of a DMF solution for ultrasonic treatment for 5 min, heated from room temperature to 160° C. for 30 min, then kept at 160° C. for 20 h, naturally cooled, washed with water for many times, so as to obtain formate-modified cupronickel faucet. The cupronickel faucets before and after the formate modification were placed in a 0.1 M sodium hydroxide solution and treated at 60° C. for 24 h to investigate their alkali resistance. It was found that the surface of the formate-modified cupronickel faucet was not blackened after alkali treatment, and was still silvery white, while the surface of the cupronickel faucet without formate modification was blackened.

Example 1-13

Figure 10:
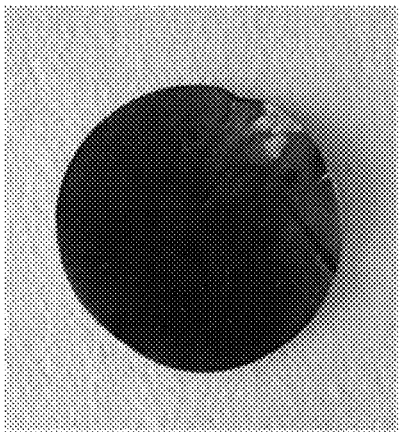
FIG. 10 is an optical photograph of an unmodified brass foil after alkali treatment of Example 1-13.
Figure 11:
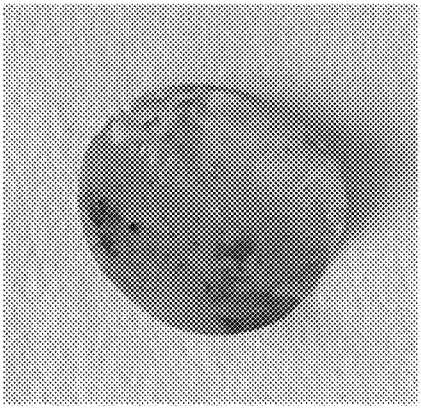
FIG. 11 is an optical photograph of the formate-treated brass foil after alkali treatment of Example 1-13.

The brass foil was placed in a high-temperature and high-pressure vessel containing 500 mg of sodium formate and 100 mL of a DMF solution for, heated from room temperature to 160° C. for 30 min, then kept at 160° C. for 20 h, naturally cooled, washed with water for many times, so as to obtain formate-modified brass foil. The brass foils before and after formate modification were placed in a 0.1 M sodium hydroxide solution and treated in an air atmosphere at 60° C. for 24 h to investigate alkali resistance of them. As shown in FIG. 10, the surface of the untreated brass foil was blackened after being soaked in an alkali solution. As shown in FIG. 11, it was found that the surface of the formate-modified brass foil was not blackened after alkali treatment, and still remained yellow, while the surface of the brass foil without formate modification was blackened.

Example 1-14

Figure 12:
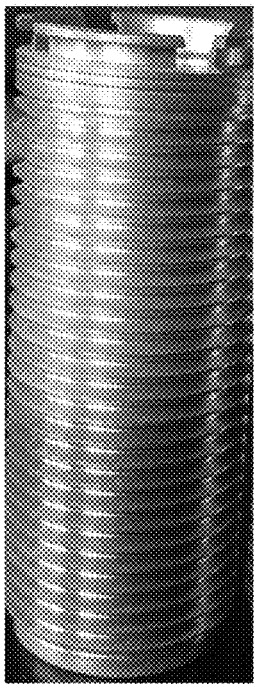
FIG. 12 is an optical photograph of a formate-treated brass casting after alkali treatment of Example 1-14.

A brass casting was taken and placed in a high-temperature and high-pressure vessel containing 500 mg of sodium formate and 100 mL of a DMF solution, heated from room temperature to 200° C. for 30 min, then kept at 200° C. for 20 h, naturally cooled, washed with water for many times, so as to obtain a formate-modified brass casting. The brass castings before and after formate modification were placed in a 0.1 M sodium hydroxide solution and treated in air atmosphere at 60° C. for 24 h to investigate their alkali resistance. As shown in FIG. 12, it was found that the surface of the formate-modified brass casting was not blackened after the alkali treatment, and still had metallic luster, while the surface of the brass casting without formate modification was blackened.

Example 2-1

Figure 13:
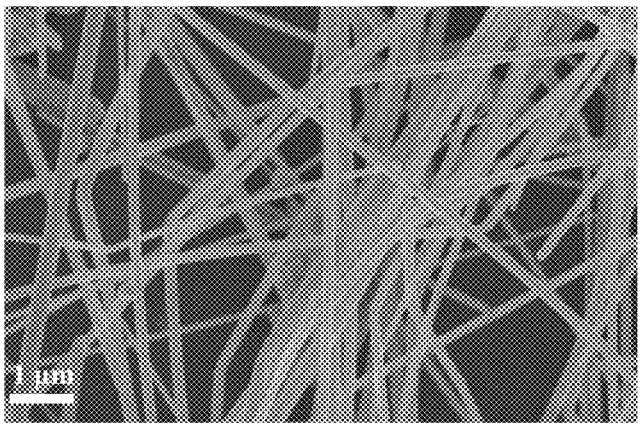
FIG. 13 is an SEM image of a freshly prepared copper nanowire of Example 2-1, where the diameter of the nanowire is 50-200 nm, and the surface of the copper nanowire is smooth.

Preparation of a copper nanowire with a diameter of 50-200 nm: firstly, 1.7 g of CuCl2·2H2O (10 mmol) and 1.93 g of glucose (10 mmol) were weighed, dissolved in 200 mL of deionized water and mixed uniformly under stirring; then, a mixed solution consisting of 20 mL of oleylamine, 0.2 mL of oleic acid and 35 mL of ethanol was slowly added into the mixed aqueous solution of $CuCl_2.2H_2O$ and glucose, and then diluted to 1000 mL. The aforementioned mixed solution was pre-reacted in an oil bath of 50° C. for 12 h, then transferred into a hydrothermal reaction kettle after the reaction was completed, and reacted at 120° C. for 6 h. Finally, a red precipitate appeared at the bottom of the reaction kettle, which was the copper nanowire. The copper nanowire was dissolved in an ethanol solution containing polyvinylpyrrolidone (2.0 wt %) for ultrasonic dispersion until uniform dispersion, and centrifuged at 6,000 r/min for 5 min. The precipitate was collected, ultrasonically dispersed in anhydrous ethanol, and then centrifuged twice to remove excess polyvinylpyrrolidone. Finally, the copper nanowire was dispersed in ethanol, and subjected to suction filtering, and the filter cake was baked in a drying oven for later use. FIG. 13 was an SEM image of a freshly prepared copper nanowire. It could be seen that the prepared copper nanowire had a diameter of 50-200 nm, had a smooth surface, and had no sign of oxidation.

100 mg of a copper nanowire was weighed, ultrasonically washed with hot anhydrous ethanol for 10 min for multiple times to remove an organic matter from the surface, then rinsed with deionized water to remove ethanol from the surface, dispersed in 0.1 M diluted hydrochloric acid and subjected to ultrasonic treatment for 20 min to remove the oxide layer from the surface, then ultrasonically washed with ultrapure water for 10 min, and dried for later use. The copper nanowire was placed in a high temperature and high pressure vessel containing 200 mg of lithium formate and 10 mL of a DMF solution for ultrasonic treatment for 5 min, added with 1 mL of dodecylamine, heated from room temperature to 160° C. within 30 min, then kept at 160° C. for 16 h, naturally cooled, and centrifugally washed with ultrapure water and anhydrous ethanol for many times, so as to obtain the formate-modified copper nanowire.

Figure 14:
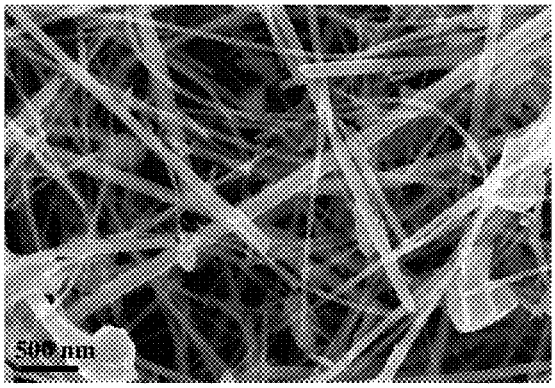
FIG. 14 is an SEM image of the formate-modified copper nanowire of Example 2-1, where the diameter of the nanowire is 50-200 nm, and the surface of the copper nanowire is provided with a small amount of organic molecular films, and retains the morphology of the copper nanowire.

FIG. 14 was an SEM image of the prepared formate-modified copper nanowire. It could be seen that the diameter of the formate-modified copper nanowire was 50-200 nm, and the structure of the intact nanowire was still maintained. The copper nanowire and the formate-modified copper nanowire were aged in an oven at 80° C. for 48 h respectively, and the morphologies of the copper nanowires before and after aging were characterized by scanning electron microscopy. Surface XRD was used to measure the crystal structures of the copper nanowires before and after oxidation, and a four-probe tester was used to measure the surface resistance change of the copper nanowire over time before and after modification.

Figure 15:
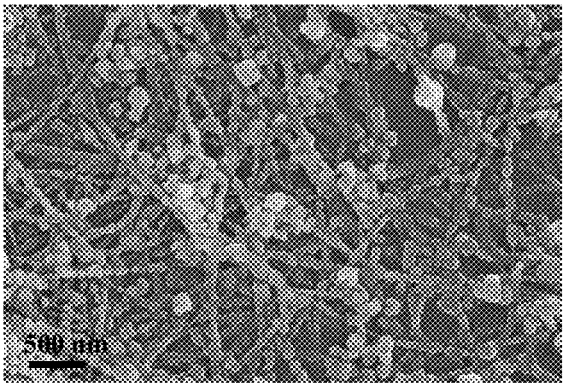
FIG. 15 is an SEM image of the copper nanowire without formate modification of Example 2-1 after being placed in air at 80° C. for 48 h.
Figure 16:
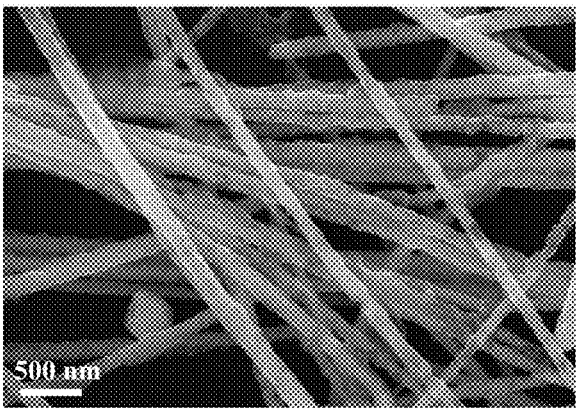
FIG. 16 is an SEM image of the formate-modified nanowire of Example 2-1 after being placed at 80° C. for 48 h.

FIG. 15 was an SEM image of the copper nanowire without formate modification after being aged in an oven at 80° C. for 48 h. The result was that the nanowire was almost completely destroyed, and obvious nanoparticles could be seen, which might be copper oxide particles. FIG. 16 was an SEM image of the formate-modified copper nanowire after being aged in an oven at 80° C. for 48 h, where the entire nanowire structure of the formate-modified copper nanowire was still maintained.

Example 2-2

Figure 17:
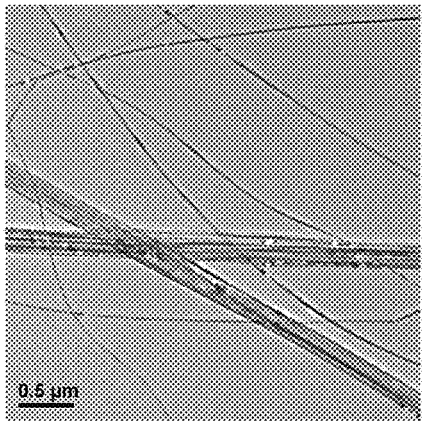
FIG. 17 is a TEM image of a freshly prepared copper nanowire with a diameter of 20 nm in Example 2-2.

Preparation of a copper nanowire with an average diameter of 20 nm: 0.5 mmol of copper chloride was weighed, ultrasonically dispersed in 5 mL of oleylamine, slowly heated to 70° C. under the protection of nitrogen, added with 0.424 g of benzoin under the condition of stirring, heated to 120° C. while stirring in a nitrogen atmosphere, and stabilized at this temperature for 30 min. The nitrogen was removed, and it was heated to 185° C. in a sealed environment, and kept at this temperature for 3 h, so as to obtain an ultrafine copper nanowire with an average diameter of 20 nm. The copper nanowire was washed with hot ethanol and n-hexane for several times to remove free organic matters, and finally the filter cake was baked in a drying oven for later use. FIG. 17 was a TEM image of the prepared copper nanowire with an average diameter of 20 nm, showing that the copper nanowire had good flexibility, a diameter of 10-30 nm and a length of about 10 μm.

50 mg of a copper nanowire was weighed, ultrasonically washed with hot anhydrous ethanol for 5 min for multiple times to remove an organic matter from the surface, and dried for later use. The copper nanowire was placed in a high temperature and high pressure vessel containing 200 mg of calcium formate, 1 mL of deionized water and 10 mL of a benzyl alcohol solution for ultrasonic treatment for 5 min, heated from room temperature to 160° C. within 30 min, then kept at 160° C. for 20 h, naturally cooled, and washed with ultrapure water for many times, so as to obtain a formate-modified antioxidative copper nanowire.

Figure 18:
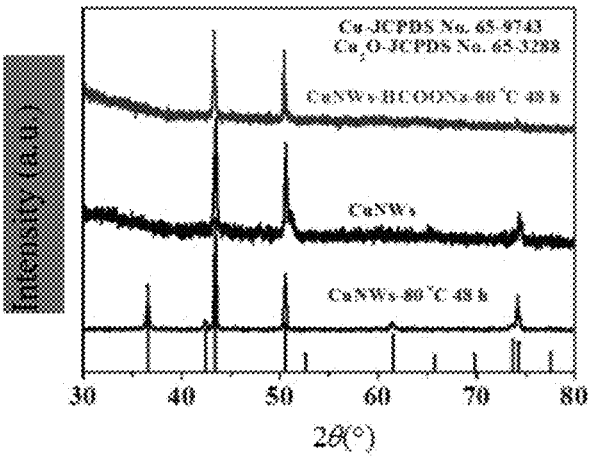
FIG. 18 is an XRD pattern of the formate-modified copper nanowires of Example 2-2 before and after the modification, after being heated at 80° C. for different times.
Figure 19:
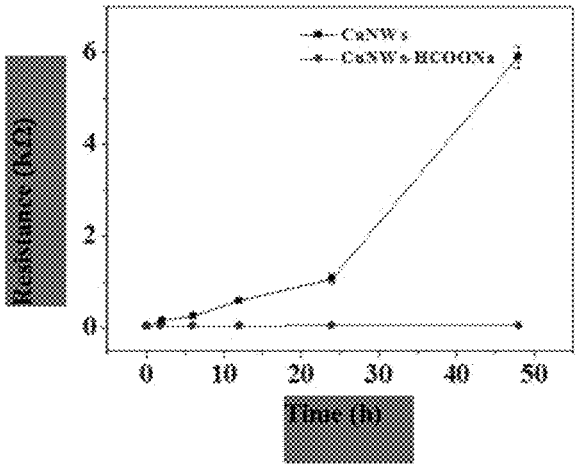
FIG. 19 is a resistance change curve of formate-modified and unmodified copper nanowires of Example 2-2 after being heated at 80° C. for different times.

FIG. 18 was an XRD pattern of the formate-modified copper nanowires before and after the modification, after being heated at 80° C. for different times. FIG. 18 illustrated that the peak of the (111) crystal plane of cuprous oxide appeared after the unmodified copper nanowire was heated placed at room 80° C. for 48 h, and the copper wire slowly turned black, while the formate-modified copper nanowire was still red after being heated at 80° C. for 48 h, and no peak of copper oxide occurred. FIG. 19 was a graph showing a curve of the resistance change of the copper nanowire before and after formate modification over time under the aging condition of 80° C. It could be obviously seen that, the resistance of the formate-modified copper nanowire remained unchanged, while the resistance of the unmodified copper nanowire was increased sharply.

Example 2-3

200 mg of a copper nanowire with a diameter of 50-200 nm was weighed, ultrasonically washed with hot anhydrous ethanol for 10 min for many times to remove an organic matter from the surface, then rinsed with deionized water to remove ethanol from the surface, dispersed in 0.05 M diluted sulfuric acid and subjected to ultrasonic treatment for 20 min to remove the oxide layer from the surface, then ultrasonically washed with ultrapure water for 10 min, and dried for later use. The copper nanowire was placed in a high temperature and high pressure vessel containing 500 mg of magnesium formate and 10 mL of an ethylene glycol solution for ultrasonic treatment for 5 min, heated from room temperature to 150° C. within 30 min, then kept at 150□ for 15 h, naturally cooled, washed with ultrapure water and anhydrous ethanol for many times, so as to obtain the formate-modified antioxidative copper nanowire.

Example 2-4

50 mg of a copper nanowire with a diameter of 20 nm was weighed, ultrasonically washed with hot anhydrous ethanol and acetone for 5 min for multiple times to remove an organic matter from the surface, then rinsed with deionized water to remove ethanol from the surface, dispersed in 0.1 M diluted hydrochloric acid and subjected to ultrasonic treatment for 10 min to remove the oxide layer from the surface, then ultrasonically washed with 75% ethanol for 10 min, and dried for later use. The copper nanowire was placed in a high temperature and high pressure vessel containing 100 mg of sodium formate and 10 mL of a DMF solution for ultrasonic treatment for 5 min, added with 0.2 mL of oleylamine, heated from room temperature to 160° C. within 30 min, then kept at 160° C. for 10 h, naturally cooled, and washed with ultrapure water and anhydrous ethanol for many times, so as to obtain an formate-modified antioxidative copper nanowire.

Example 3-1

Step 1. Surface cleaning.

(1) A bunch of copper wire filaments was taken, and treated with a solvent of ethanol for a time of 15 min to remove an organic matter;

(2) the bunch of copper wire filaments was cleaned with running water;

(3) the bunch of copper wire filaments was subjected to acid pickling with sulfuric acid at a concentration of 0.05 M for 5 min;

(4) the bunch of copper wire filaments was rinsed with a mixed solvent of ethanol and water at a weight ratio of 1:1 for 5 min; and (5) the bunch of copper wire filaments was dried;

Step 2: anti-corrosion treatment. The stabilizer as used was 16 g/L of sodium formate, the polar solvent was N,N-dimethylformamide and water, where the concentration of N,N-dimethylformamide was 0.940 g/mL, and the rest was water, and the sealing and pressurizing reaction was conducted in a pressure container at a temperature of 150° C. for 18 h;

Step 3: cleaning with ethanol, and drying.

An untreated copper wire was put into a 0.1 M NaOH solution for alkali resistance test at 60° C. for 24 h. The photograph of the result was shown in FIG. 20.

The copper wire obtained by treating in Example 3-1 was put into a 0.1 M NaOH solution for alkali resistance test at a temperature of 60° C. for a period of 24 h. The photograph of the obtained result was shown in FIG. 21.

Figure 20:
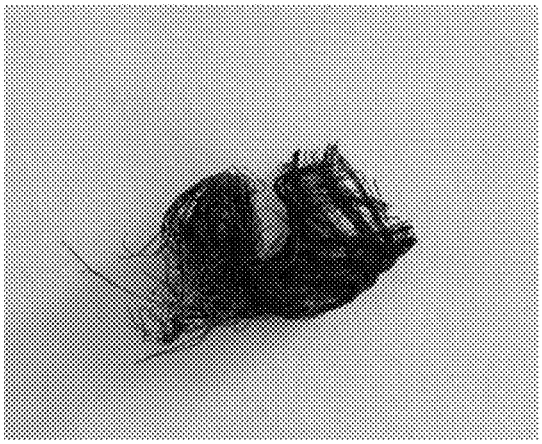
FIG. 20 is the result of alkali treatment of the copper wire without formate modification in Example 3-1.
Figure 21:
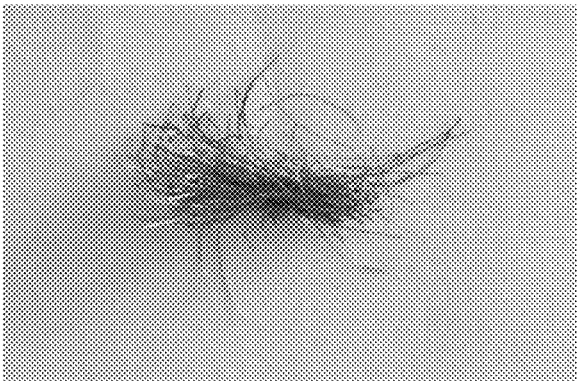
FIG. 21 is the result of alkali treatment of the formate-modified copper wire of Example 3-1.

It could be seen from the comparison between FIG. 20 and FIG. 21 that, the untreated copper wire was blackened and had poor alkali resistance, while the copper wire treated in Example 3-1 had a smooth and glossy surface and had alkali resistance.

Figure 22:
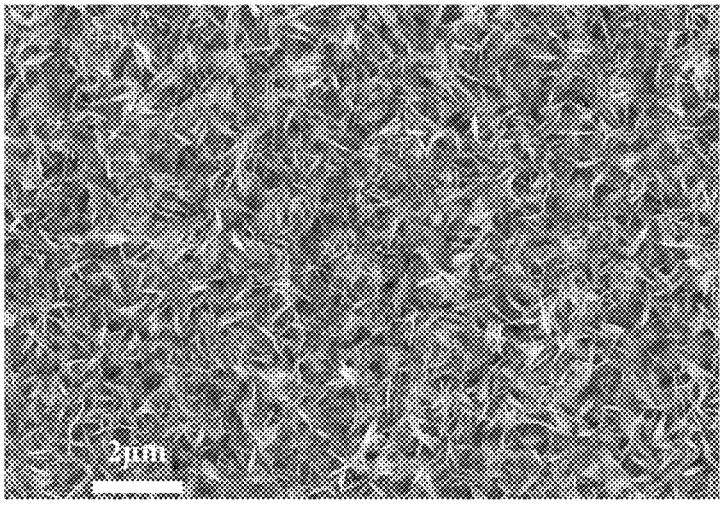
FIG. 22 is an SEM image of the copper wire of FIG. 20.

The copper wire in FIG. 20 was observed for surface morphology on a scanning electron microscope. FIG. 22 was an SEM photograph of the copper wire of FIG. 20. As could be seen from the figure, the surface was rough and had been oxidized, indicating that it did not have alkali resistance.

Figure 23:
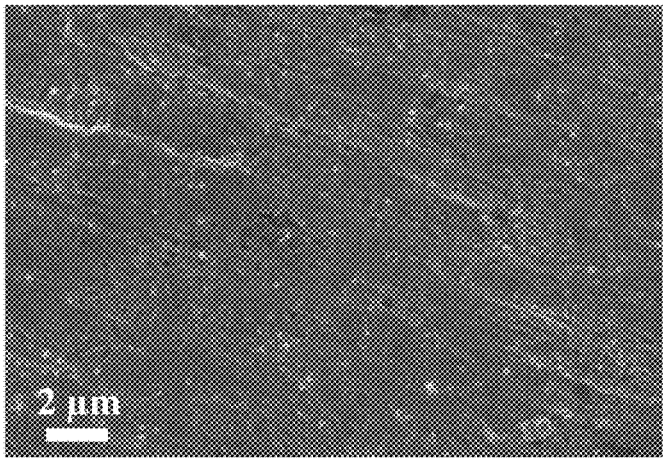
FIG. 23 is an SEM image of the copper wire of FIG. 21.

The copper wire in FIG. 21 was observed for surface morphology on a scanning electron microscope. FIG. 23 was an SEM photograph of the copper wire of FIG. 21. As could be seen from the figure, the surface was smooth and seamless, had not been oxidized, and had alkali resistance.

Example 3-2

Step 1. Surface cleaning.

(1) A copper wire with a diameter of 2.5 mm and a length of 10 cm was taken, and treated with a solvent of ethanol for a time of 18 min to remove an organic matter;

(2) the copper wire was cleaned with running water;

(3) the copper wire was subjected to acid pickling with sulfuric acid at a concentration of 0.075 M for 8 min;

(4) the copper wire was rinsed with a mixed solvent of ethanol and water at a weight ratio of 1:1 for 8 min; and (5) the copper wire was dried;

Step 2: anti-corrosion treatment. The corrosion inhibitor as used was 17 g/L of potassium formate, the polar solvent was 0.942 g/mL of formamide, and the sealed reaction was conducted in a pressure vessel at a temperature of 160° C. for 19 h;

Step 3: cleaning with ethanol, and drying.

Example 3-3

Step 1. Surface cleaning.

(1) A copper wire with a diameter of 2.5 mm and a length of 140 cm was taken, wound into a spring shape as a copper winding, and treated with a solvent of ethanol for a time of 20 min to remove an organic matter;

(2) the copper wire was cleaned with running water;

(3) the copper wire was subjected to acid pickling with sulfuric acid at a concentration of 0.10 M for 10 min;

(4) the copper wire was rinsed with a mixed solvent of ethanol and water at a weight ratio of 1:1 for 10 min; and (5) the copper wire was dried;

Step 2: anti-corrosion treatment. The corrosion inhibitor as used was 18 g/L of lithium formate, the polar solvent was 0.945 g/mL of diethylformamide, and the sealed reaction was conducted in a pressure vessel at a temperature of 170° C. for 20 h;

Step 3: cleaning with water, and drying.

Figure 24:
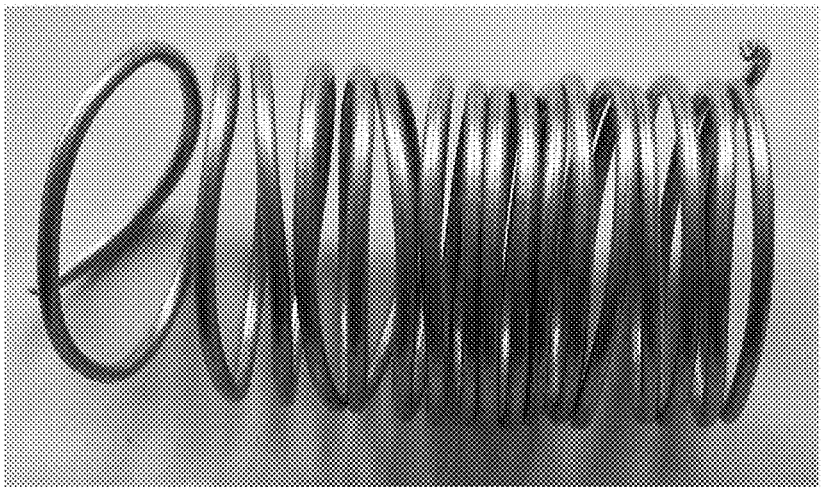
FIG. 24 is a photograph of a copper winding without any treatment in Example 3-3.

A copper wire with a diameter of 2.5 mm and a length of 140 cm was taken, wound into a spring shape as a copper winding, and subjected to no treatment to obtain FIG. 24.

Figure 25:
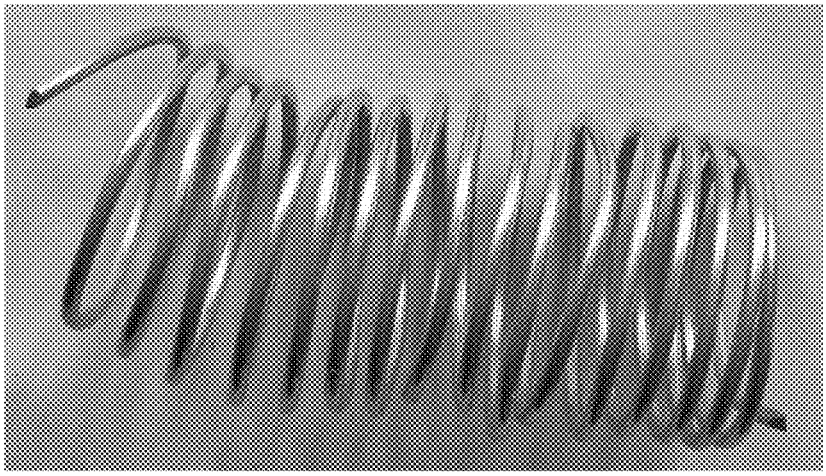
FIG. 25 is a photograph of a formate-modified copper winding of Example 3-3.

The copper winding obtained after the treatment in Example 3-3 was shown in FIG. 25.

As could be seen from the comparison between FIG. 24 and FIG. 25, the surface of the untreated copper winding was dim and dark, while the surface of the formate-modified copper winding was glossy and shiny.

Example 3-4

Step 1. Surface cleaning.

(1) A copper bar with a length of 5 cm and a width of 5 mm was taken, and treated with a solvent of ethanol for a time of 22 min to remove an organic matter;

(2) the copper bar was cleaned with running water;

(3) the copper bar was subjected to acid pickling with sulfuric acid at a concentration of 0.12 M for 12 min;

(4) the copper bar was rinsed with a mixed solvent of ethanol and water at a weight ratio of 1:1 for 12 min; and (5) the copper bar was dried;

Step 2: anti-corrosion treatment. The corrosion inhibitor as used was 19 g/L of ammonium formate, the polar solvent was 0.948 g/mL of dimethylacetamide, and the sealed reaction was conducted in a pressure vessel at a temperature of 180° for 22 h;

Step 3: cleaning with water, and drying.

Example 3-5

Step 1. Surface cleaning.

(1) A copper strip with a length of 6 cm and a width of 3 cm was taken, and treated with a solvent of ethanol for a time of 25 min to remove an organic matter;

(2) the copper strip was cleaned with running water;

(3) the copper strip was subjected to acid pickling with sulfuric acid at a concentration of 0.15 M for 15 min;

(4) the copper strip was rinsed with a mixed solvent of ethanol and water at a weight ratio of 1:1 for 15 min; and (5) the copper strip was dried;

Step 2: anti-corrosion treatment. The corrosion inhibitor as used was 20 g/L of magnesium formate, the polar solvent was 0.950 g/mL of diethylacetamide, and the sealed reaction was conducted in a pressure vessel at a temperature of 160° for 24 h;

Step 3: cleaning with ethanol, and drying.

Example 4-1

Step 1. Surface cleaning.

(1) A piece of brass foil with a length of 8 cm and a width of 2.5 cm was taken, and treated with a solvent of ethanol for a time of 15 min to remove an organic matter;

(2) the brass foil was cleaned with running water;

(3) the brass foil was treated with analytically pure acetone for 5 min to remove the oxide film;

(4) the brass foil was rinsed with a mixed solvent of ethanol and water at a weight ratio of 1:1 for 5 min; and (5) the brass foil was dried;

Step 2: anti-corrosive treatment. The corrosion inhibitor as used was 16 g/L of sodium formate, the polar solvent was 0.940 g/mL of N,N-dimethylformamide, and the sealed reaction was conducted in a pressure vessel at a temperature of 150° for 18 h;

Step 3: cleaning with water, and drying.

An untreated brass foil was put into a 0.1 M NaOH solution for alkali resistance test at 60° C. for 24 h. The photograph of the obtained result was shown in FIG. 26.

The brass foil obtained after treatment in Example 4-1 was put into a 0.1 M NaOH solution for an alkali resistance test at 60° C. for 24 h. The photograph of the obtained result was shown in FIG. 27.

Figure 26:
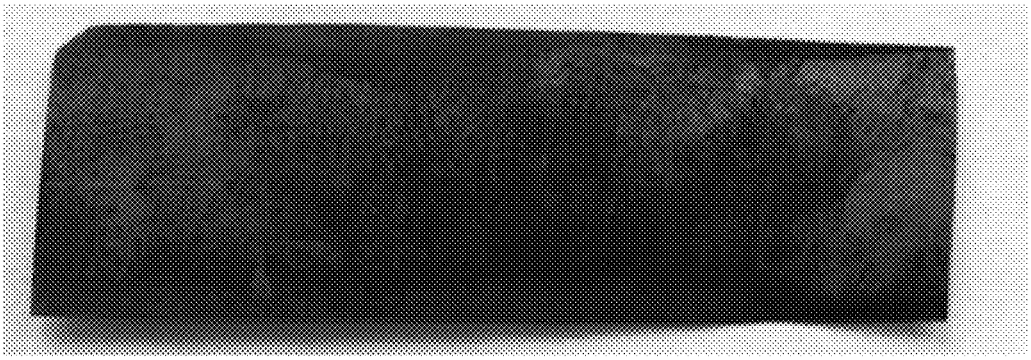
FIG. 26 is the result of alkali treatment of the brass foil without formate modification in Example 4-1.
Figure 27:
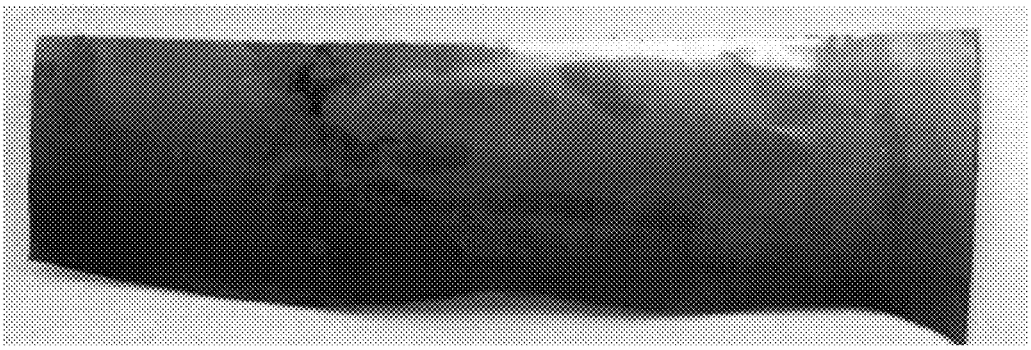
FIG. 27 is the result of alkaline treatment of a formate-modified brass foil in Example 4-1.

It could be seen from the comparison between FIG. 26 and FIG. 27 that, the untreated brass foil was blackened and had poor alkali resistance, while the brass foil treated in Example 4-1 had a smooth and glossy surface and had alkali resistance.

Figure 28:
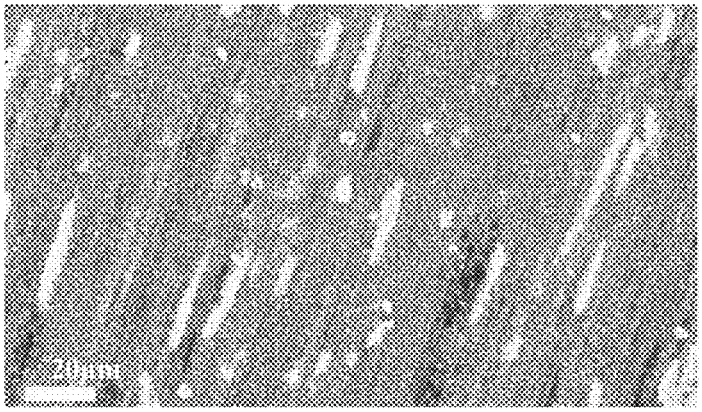
FIG. 28 is an SEM image of the brass foil in FIG. 26.

The brass foil in FIG. 26 was observed for surface morphology on a scanning electron microscope. FIG. 28 was an SEM photograph of the brass foil in FIG. 26. As could be seen from the figure, the surface was rough and had been oxidized, indicating that it did not have alkali resistance.

Figure 29:
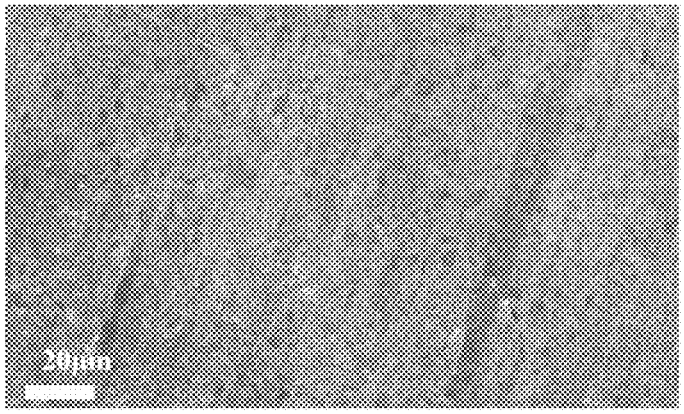
FIG. 29 is an SEM image of the brass foil in FIG. 27.

The brass foil in FIG. 27 was observed for surface morphology on a scanning electron microscope. FIG. 29 was an SEM photograph of the brass foil in FIG. 27. As could be seen from the figure, the surface was smooth and seamless, had not been oxidized, and had alkali resistance.

Example 4-2

Step 1. Surface cleaning.

(1) A cupronickel faucet casting was taken, and treated with a solvent of ethanol for a time of 18 min to remove an organic matter;

(2) the cupronickel faucet casting was cleaned with running water;

(3) the cupronickel faucet casting was treated with analytically pure acetone for 8 min to remove the oxide film;

(4) the cupronickel faucet casting was rinsed with a mixed solvent of ethanol and water at a weight ratio of 1:1 for 8 min; and (5) the cupronickel faucet casting was dried;

Step 2: anti-corrosive treatment. The corrosion inhibitor as used was 17 g/L of lithium formate, the polar solvent was 0.942 g/mL of formamide, and the sealed reaction was conducted in a pressure vessel at a temperature of 160° C. for 19 h;

Step 3: cleaning with ethanol, and drying.

Example 4-3

Step 1. Surface cleaning.

(1) A brass gasket was taken, and treated with a solvent of ethanol for a time of 20 min to remove an organic matter;

(2) the brass gasket was cleaned with running water;

(3) the brass gasket was treated with analytically pure acetone for 10 min to remove the oxide film;

(4) the brass gasket was rinsed with a mixed solvent of ethanol and water at a weight ratio of 1:1 for 10 min; and (5) the brass gasket was dried;

Step 2: anti-corrosive treatment. The corrosion inhibitor as used was 18 g/L of potassium formate, the polar solvent was 0.945 g/mL of diethylformamide, and the sealed reaction was conducted in a pressure vessel at a temperature of 170° C. for 20 h;

Step 3: cleaning with water, and drying.

Example 4-4

Step 1. Surface cleaning.

(1) A cupronickel coin was taken, and treated with a solvent of ethanol for a time of 22 min to remove an organic matter;

(2) the cupronickel coin was cleaned with running water;

(3) the cupronickel coin was treated with analytically pure acetone for 12 min to remove the oxide film;

(4) the cupronickel coin was rinsed with a mixed solvent of ethanol and water at a weight ratio of 1:1 for 12 min; and (5) the cupronickel coin was dried;

Step 2: anti-corrosive treatment. The corrosion inhibitor as used was 19 g/L of magnesium formate, the polar solvent was 0.948 g/mL of dimethylacetamide, and the sealed reaction was conducted in a pressure vessel at a temperature of 180° C. for 22 h;

Step 3: cleaning with ethanol, and drying.

Example 4-5

Step 1. Surface cleaning.

(1) A bronze spring was taken, and treated with a solvent of ethanol for a time of 25 min to remove an organic matter;

(2) the bronze spring was cleaned with running water;

(3) the bronze spring was treated with analytically pure acetone for 15 min to remove the oxide film;

(4) the bronze spring was rinsed with a mixed solvent of ethanol and water at a weight ratio of 1:1 for 15 min; and (5) the bronze spring was dried;

Step 2: anti-corrosive treatment. The corrosion inhibitor as used was 20 g/L of ammonium formate, the polar solvent was 0.950 g/mL of diethylacetamide, and the sealed reaction was conducted in a pressure vessel at a temperature of 160° for 24 h;

Step 3: cleaning with water, and drying.

The preferred embodiments of the present invention have been described in detail above. However, the present invention is not limited to the specific details in the above embodiments. Within the scope of the technical concept of the present invention, many simple modifications can be made to the technical solution of the present invention, all of which fall within the claimed scope of the present invention.

Furthermore, it should be noted that various specific technical features described in the above specific embodiments can be combined in any suitable way without contradiction. In order to avoid unnecessary repetition, various possible combination manners will not be described separately in the present invention.

Furthermore, any combination can be made among various embodiments of the present invention, as long as it does not violate the idea of the present invention, it should also be regarded as the disclosure of the present invention.

What is claimed is:

1. A method for anti-corrosion treatment of metallic copper-containing materials, comprising subjecting the metallic copper-containing materials and a stabilizer to a sealing and pressurizing reaction in the presence of a polar solvent and an additive, wherein the sealing and pressurizing reaction is conducted at a temperature of 120-180° C. for a time of 6-30 h, wherein the stabilizer is a compound capable of providing a formate, so that the formate is adsorbed on the surfaces of the metallic copper-containing materials, wherein the stabilizer is a formate salt, and wherein the formate salt is at least one selected from lithium formate, sodium formate, cesium formate, magnesium formate, aluminium triformate, potassium formate, ammonium formate, calcium formate, iron formate, strontium formate, barium formate, beryllium formate, nickel formate, cobalt formate, and manganese formate, wherein the additive is oleylamine, wherein the metallic copper-containing materials are copper nanowires, a diameter of the copper nanowires being 10-200 nm, the method for anti-corrosion treatment comprises the following steps:

1) Adding the copper nanowire into a dispersant, then adding the polar solvent and the oleylamine, the polar solvent being a polar organic solvent and/or water, and mixing to obtain a copper nanowire dispersion solution; wherein the dispersant is polyvinylpyrrolidone;

2) Adding the stabilizer into the copper nanowire dispersion solution obtained in the Step 1), and mixing to obtain a mixed solution;

3) Placing the mixed solution into a pressurized and heated sealing system for a sealing reaction; and 4) cooling the mixed solution obtained in the Step 3), then performing liquid-solid separation, and washing.

2. The method for anti-corrosion treatment according to claim 1, comprising drying after Step (4).

3. The method for anti-corrosion treatment according to claim 1, wherein the mass ratio of the stabilizer to the copper nanowires is 10:1 to 1:10.

4. The method for anti-corrosion treatment according to claim 1, wherein the polar organic solvent is at least one selected from an amide solvent, an alcohol solvent, an ester solvent, and an ether solvent.

5. The method for anti-corrosion treatment according to claim 4, wherein the amide solvent is at least one selected from form amide, dimethylformamide, diethylformamide, dimethylacetamide, diethylacetamide, and dimethylpropionamide; the alcohol solvent is at least one selected from monohydric alcohol, dihydric alcohol and polyhydric alcohol; the ester solvent is at least one selected from ethyl acetate, methyl acetate, n-butyl acetate, n-pentyl acetate, ethyl valerate, ethyl propionate, ethyl butyrate, ethyl lactate, ethyl nonanoate, triethyl phosphate, ethyl caproate, ethyl formate, ethyl cyclohexanecarboxylate, ethyl heptanoate, and ethyl cinnamate; and the ether solvent is at least one selected from methyl ether, diethyl ether, diphenyl ether, ethylene oxide, and tetrahydrofuran.

6. The method for anti-corrosion treatment according to claim 1, wherein the mass ratio of the copper nanowires is 50:1-1:100.

7. The method for anti-corrosion treatment according to claim 1, wherein in the Step 1), the mass ratio of the dispersant to the copper nanowires is 100:1-1:100.

* * * * *